US011465440B1

(12) United States Patent
Adorno, Jr.

(10) Patent No.: US 11,465,440 B1
(45) Date of Patent: Oct. 11, 2022

(54) ARTWORK HAVING REFLECTIVE ELEMENTS AND METHODS OF PREPARING THE SAME

(71) Applicant: Frank C. Adorno, Jr., Elmhurst, IL (US)

(72) Inventor: Frank C. Adorno, Jr., Elmhurst, IL (US)

( * ) Notice: Subject to any disclaimer, the term of this patent is extended or adjusted under 35 U.S.C. 154(b) by 0 days.

(21) Appl. No.: 17/228,037

(22) Filed: Apr. 12, 2021

(51) Int. Cl.
*B44F 1/02* (2006.01)
*B44C 1/18* (2006.01)

(52) U.S. Cl.
CPC . *B44F 1/02* (2013.01); *B44C 1/18* (2013.01)

(58) Field of Classification Search
CPC .... B44C 1/18; B44F 1/04; B44F 1/045; B44F 1/06; B44F 1/066; B44F 1/14; B44F 1/10; B44F 1/02
See application file for complete search history.

(56) References Cited

U.S. PATENT DOCUMENTS 3,236,368 A 2/1966 Eisen
3,553,062 A 1/1971 Berlin
5,079,644 A * 1/1992 Elliott ..... G02B 5/136 359/546
5,084,309 A 1/1992 Smith et al.
5,173,324 A 12/1992 Newhart
5,470,410 A 11/1995 Keating et al.
5,741,578 A * 4/1998 Sax ..... G09F 19/12 428/912.2
5,902,670 A 5/1999 Ripstein
8,966,796 B2 3/2015 Ridless et al.
9,747,821 B2 8/2017 Gastelum
2007/0065646 A1 3/2007 Chaimberg

OTHER PUBLICATIONS

"Resin Geode Pour on Canvas with Glitter" (ETI Resin Crafts Blog; Jan. 20, 2020; https://resincraftsblog.com/resin-geode-pour-on-canvas-with-glitter/) (Year: 2020).*
Blue Turquoise Glitter Watercolor Art Original Paiting Canvas Print (https://society6.com/product/blue-turquoise-glitter-watercolor-art-original-painting_stretched-canvas; Review from Dec. 29, 2017) (Year: 2017).*

(Continued)

*Primary Examiner* — Laura C Powers
(74) *Attorney, Agent, or Firm* — Cook Alex Ltd.

(57) ABSTRACT

An artwork includes a frame, an image support medium bearing an image, and a plurality of reflective elements. The plurality of reflective elements is connected to the image support medium, wherein the plurality of reflective elements has a generally non-reflective appearance when viewed at an angle that is not generally parallel with an incident ray of light, and has an illuminated appearance when viewed at an angle generally in line with an incident ray of light. A method of preparing the artwork includes the steps of obtaining a frame, preparing an image on an image support medium that is on a surface of or is extended over the frame, and connecting a plurality of reflective elements to the image support medium to achieve the respective generally non-reflective appearance and illuminated appearance depending on the angle of an incident ray of light.

22 Claims, 6 Drawing Sheets

(56) References Cited

OTHER PUBLICATIONS

"Vibrant Button Tree on Canvas" (Crafts by Amanda website, https://craftsbyamanda.com/vibrant-button-tree-on-canvas-a-giveaway/; posted Oct. 8, 2016). (Year: 2016).*
"3D Pipe Cleaner Garden Art on Canvas" (via Make and Takes website, https://makeandtakes.com/pipe-cleaner-garden-art; comment from Jun. 10, 2019) (Year: 2019).*
"Caryon 100 PCS 12 Inch Glitter Tinsel Creative Arts Chenille Stems Pipe Clearers (Multicolor)" (https://www.amazon.com/dp/B01LNCWY70/ref=twister_B01LNCWYJI?_encoding=UTF8&th=1; Date First Available Sep. 6, 2016). (Year: 2016).*
"Stretched vs. Unstretched Canvas Prints" (blog post from https://www.lumaprints.com/Stretched-Vs-Unstretched-Canvas-Prints, Oct. 13, 2017) (Year: 2017).*
"These are the Best White Canvas Boards for Your Next Painting or Study" (via ARTnews website, https://www.artnews.com/art-news/product-recommendations/best-white-canvas-boards-1202686506/; May 8, 2020). (Year: 2020).*
"Taped Metal Canvas", Exhibit from Apr. 2017; http://www.tapedmetalcanvas.com/jaojou17.html (Year: 2017).*

* cited by examiner

ARTWORK HAVING REFLECTIVE ELEMENTS AND METHODS OF PREPARING THE SAME

BACKGROUND OF THE INVENTION

Field of the Invention

The present invention generally relates to artwork, and more particularly to artwork having reflective elements and methods of preparing such artwork.

Discussion of the Prior Art

Artwork comes in many forms, as the expression of artists can be quite unique. One may create using a variety of media. Paintings, prints and other visual artwork are suitable for display and may, for example, be hung on a wall.

SUMMARY OF THE INVENTION

The purpose and advantages of the invention will be set forth in and apparent from the description and drawings that follow, as well as will be learned by practice of the claimed subject matter.

This disclosure generally provides artwork having reflective elements and methods of preparing the same. The artwork may start as an abstract or objective painting, drawing, collage of fabric or other materials, a photograph, or a digital photograph manipulated to provide an abstract or objective image that can be printed onto an image support medium, such as a canvas, using a Giclée or other process. It is known to focus a light fixture on a painting or photograph hanging on a wall, simply to illuminate, and therefore, feature the presence of the artwork. However, the present disclosure incorporates a new structure for an artwork and method of preparing the artwork that includes reflective elements that permit an artist to prepare an artwork that may look much like a normal abstract or objective painting, drawing, print or the like when viewed from most vantage points, but in which the artist may invest another layer of creativity by bringing the artwork to life when viewed from an angle that is in line with an incident ray of light provided by a light source, wherein the reflective elements appear to be illuminated.

In a first aspect, this disclosure provides an artwork having reflective elements including a frame, an image support medium bearing an image, and a plurality of reflective elements. The plurality of reflective elements is connected to the image support medium, wherein the plurality of reflective elements has a generally non-reflective appearance when viewed at an angle that is not generally parallel with an incident ray of light, and has an illuminated appearance when viewed at an angle generally in line with an incident ray of light.

In a second aspect, this disclosure provides a method of preparing an artwork having reflective elements including the steps of obtaining a frame, preparing an image on an image support medium that is on a surface of or is extended over the frame, connecting a plurality of reflective elements to the image support medium, wherein the plurality of reflective elements connected to the image support medium has a generally non-reflective appearance when viewed at an angle that is not generally parallel with an incident ray of light, and has an illuminated appearance when viewed at an angle generally in line with an incident ray of light.

While the disclosure illustrates the invention in the context of certain examples of artwork constructions, it will be appreciated that an artwork having reflective elements and methods of preparing the same may be adapted for use with various frames, image support media, reflective elements and types of images.

It is to be understood that both the foregoing general description and the following detailed description are exemplary and provided for purposes of explanation only, and are not restrictive of the subject matter claimed. Further features and objects of the present disclosure will become more fully apparent in the following description of the preferred embodiments and from the appended claims.

BRIEF DESCRIPTION OF THE DRAWINGS

In describing the preferred embodiments, reference is made to the accompanying drawing figures wherein like parts have like reference numerals, and wherein.

Figure 1A:
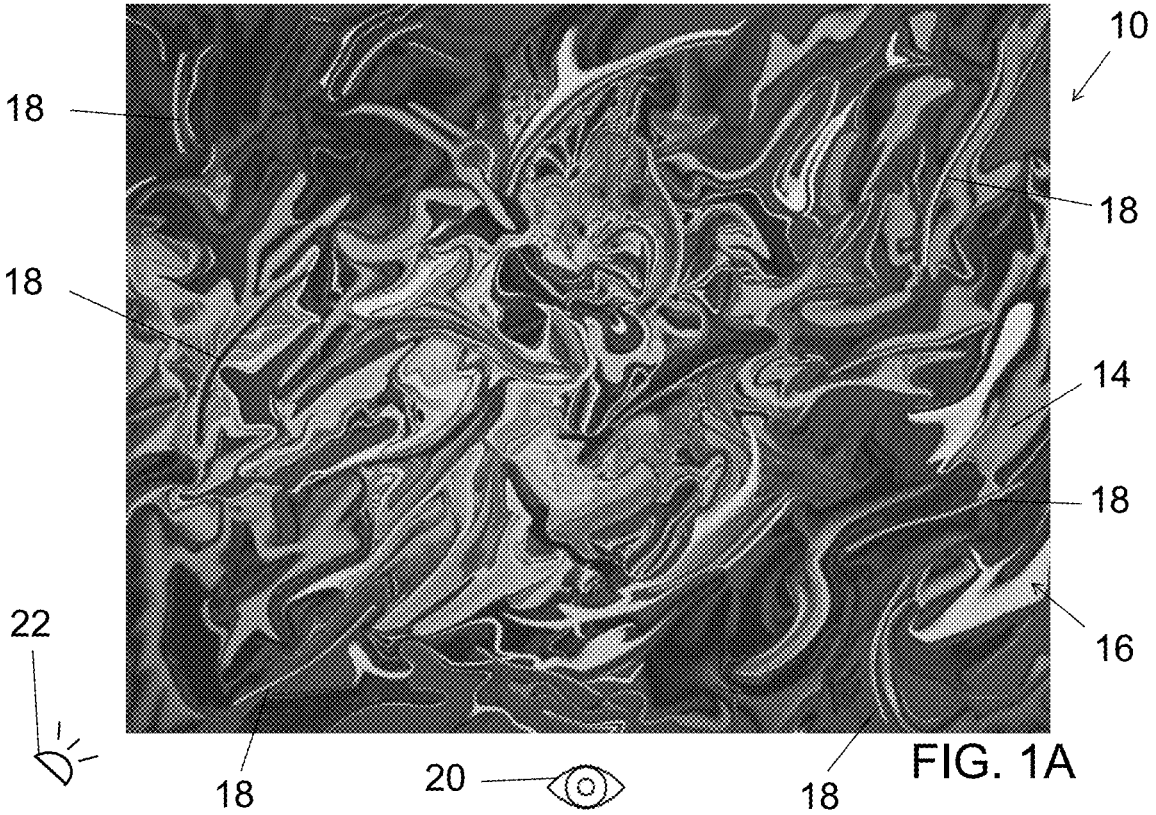
FIG. 1A shows a front view of a first example artwork of the present disclosure and depicting an image as would be seen by an observer when viewed at an angle directly in front of the artwork and which is not generally parallel with and is spaced away from a light source, which provides an incident ray of light shining on the artwork at a different angle.

It should be understood that the figures are not to scale. While some mechanical details of an artwork having reflective elements and methods of preparing the same, including additional plan and section views of the examples shown and of examples that may have alternative configurations have not been included, such details are considered to be within the comprehension of those of skill in the art in light of the present disclosure. It also should be understood that the present invention is not limited to the example embodiments illustrated.

DETAILED DESCRIPTION OF THE PREFERRED EMBODIMENT

For the following defined terms, these definitions shall be applied, unless a different definition is given in the claims or elsewhere in this disclosure. As used in this disclosure and the appended claims, the singular forms "a", "an", and "the" include plural referents unless the content clearly dictates otherwise. As used in this disclosure and the appended claims, the term "or" is generally employed in its sense including "and/or" unless the content clearly dictates otherwise.

Referring generally to FIGS. 1A-4B it will be appreciated that artwork having reflective elements and methods of preparing the same of the present disclosure generally may be embodied within numerous configurations. Indeed, while acknowledging that all of the example configurations of artwork having reflective elements and methods of preparing the same need not be shown herein, examples are provided to better demonstrate that aspects of the invention and a variety of configurations and methods of preparing the same are contemplated.

The drawing figures illustrate examples of artwork having reflective elements and methods of preparing the same. For instance, a first example artwork 10 is shown in FIGS. 1A-1I. The first example artwork 10 includes a frame 12, an image support medium 14 bearing an image 16, a plurality of reflective elements 18, with the plurality of reflective elements 18 connected to the image support medium 14. In this first example, the image support medium is extended over the frame 12. The plurality of reflective elements 18 has a generally non-reflective appearance when viewed at an angle that is not generally parallel with an incident ray of light, as seen for example in FIG. 1A. In contrast, the plurality of reflective elements 18 has a surprising and unique illuminated appearance when viewed at an angle generally in-line with an incident ray of light, as seen for example in FIG. 1B.

Thus, FIG. 1A shows an example artwork 10 of the present disclosure depicting an image 16 that is seen by an observer when viewed from an angle directly in front of the artwork 10, which is associated with the symbol of an eye 20. A light source 22 shines an incident ray of light toward the artwork 10 from a different angle, wherein the light source 22 is positioned to the left of the artwork. The image enjoyed by the observer includes the reflective elements 18, but they have a generally non-reflective appearance, which causes them to blend-in with the remainder of the image.

Figure 1B:
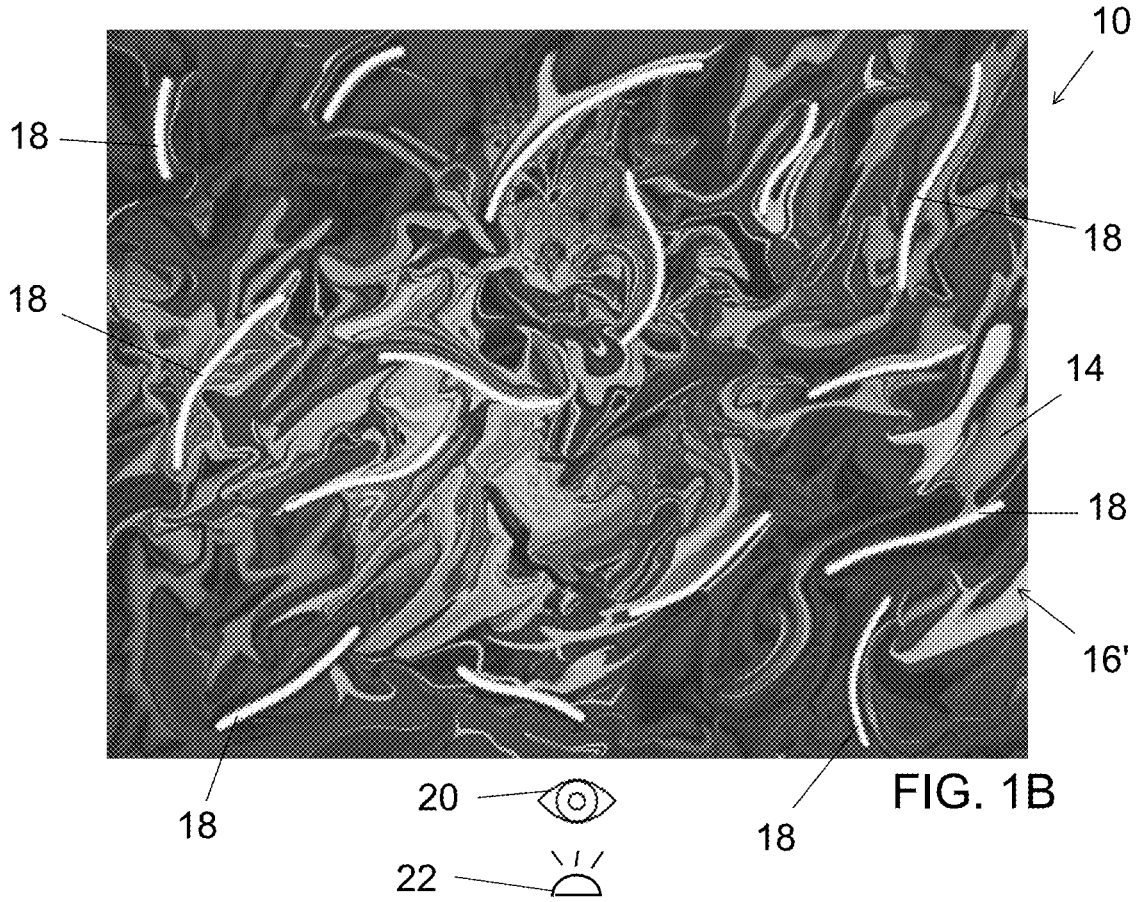
FIG. 1B shows a front view of the first example artwork of FIG. 1A depicting an image as would be seen by an observer when similarly viewed at an angle directly in front of the artwork and which is generally in line with a light source providing an incident ray of light shining on the artwork.

FIG. 1B shows the example artwork 10 of FIG. 1A depicting the image 16 that is seen by an observer when viewed from an angle directly in front of the artwork 10, which again is associated with the symbol of the eye 20. However, in FIG. 1B, the light source 22 shines an incident ray of light toward the artwork 10 from an angle that is in line with the observer. The image enjoyed by the observer still includes the reflective elements 18, but now they have a reflective, seemingly illuminated appearance, which causes them to provide highlights within the image 16. It should be noted that the observer need not be directly in front of the artwork to have these two different perceptions of the artwork, but rather the controlling aspect that results in the seemingly illuminated state is the coincidence of the angle of viewing by the observer relative to the source of light.

It will be appreciated that the image 16 may be applied to the image support medium 14 via printing, painting, drawing, or other suitable methods. For example, a digital photograph may be used in its original form as an objective image or may be manipulated to provide an abstract image, and then the image 16 may be printed on or otherwise transferred to an image support medium, such as a canvas, using the Giclée technique or other suitable processes. Various methods of painting or drawing also may be used. The image support medium 14 may be formed of a flexible sheet material constructed of a woven canvas, fabric, paper, plastic, or other suitable material. Alternatively, the upper surface of the frame may serve as the image support medium, as will be described further herein.

Figure 1C:
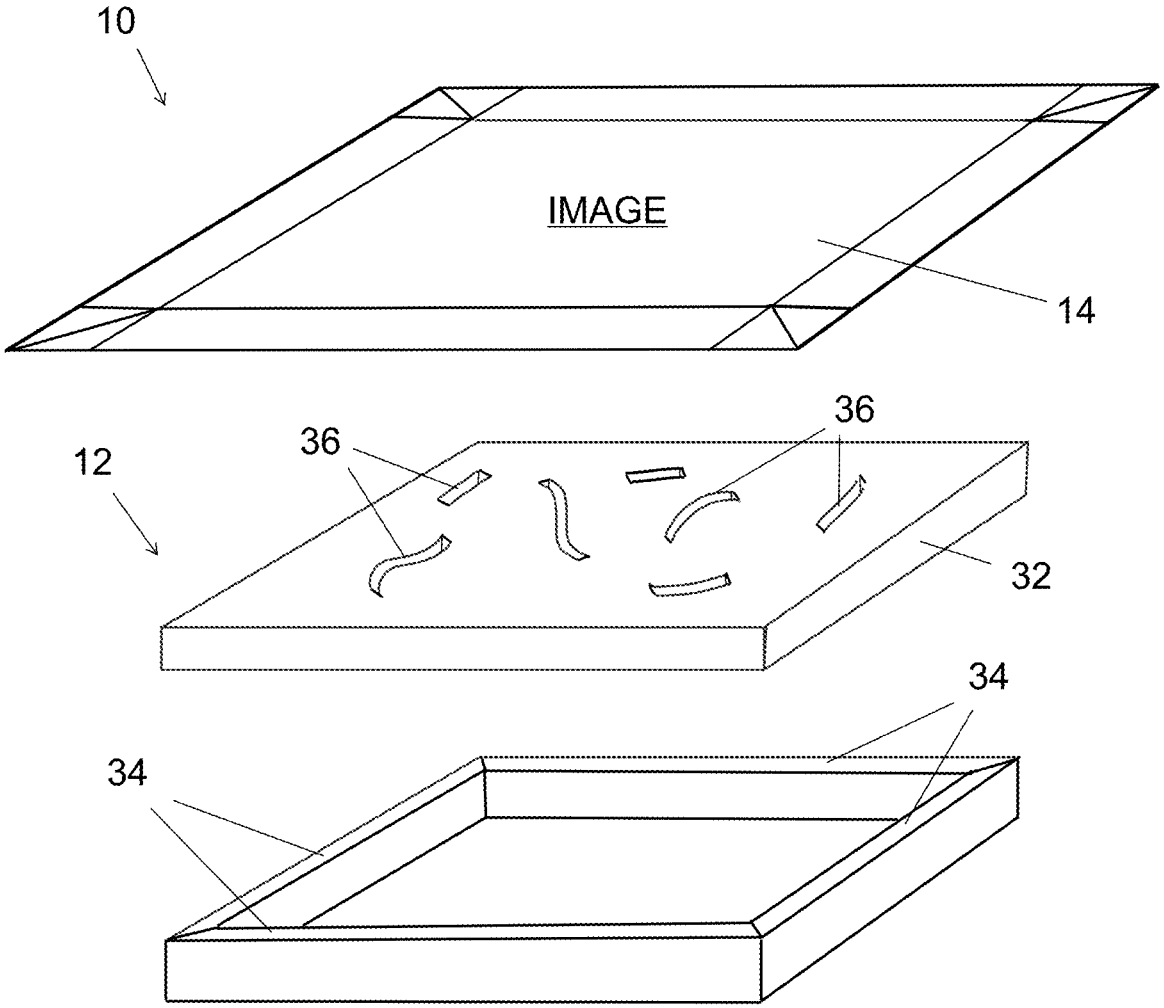
FIG. 1C is an exploded perspective view of the first example artwork showing an image support medium spaced above a frame having a generally planar substrate having elongated apertures at desired locations and wherein the frame optionally may include a plurality of frame members forming a rearward extension (this figure and the figures hereafter showing the first example do not show an image on the image support medium and show a simplified pattern of the reflective elements, for convenience of the description and viewing of the related structures).
Figure 1D:
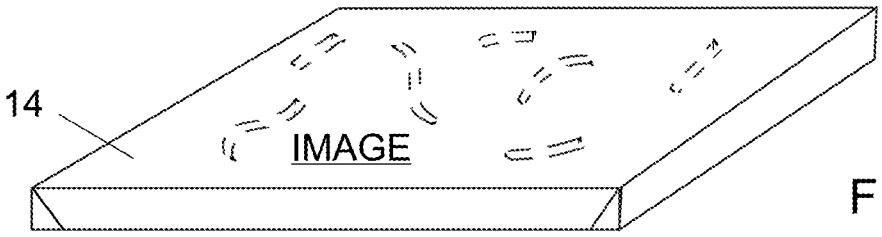
FIG. 1D is a perspective view of the first example showing the image support medium extending over the example frame of FIG. 1C without a rear extension (if shown with the image on the image support medium, this would look like an uninterrupted painting or print).
Figure 1E:
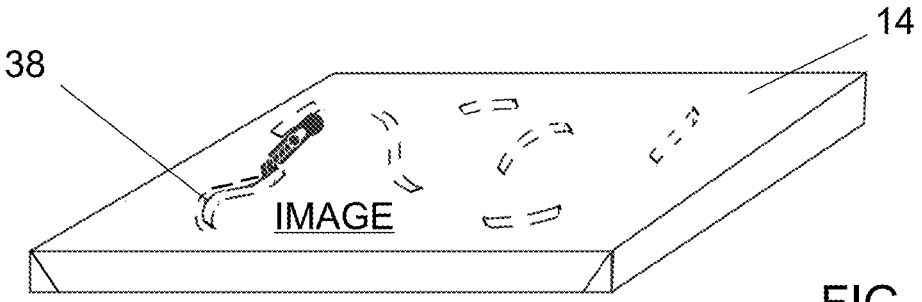
FIG. 1E is a perspective view of the first example shown in FIG. 1D and further showing a slit being made in the image support medium, which coincides with an elongated aperture in the underlying example frame of FIG. 1C.
Figure 1F:
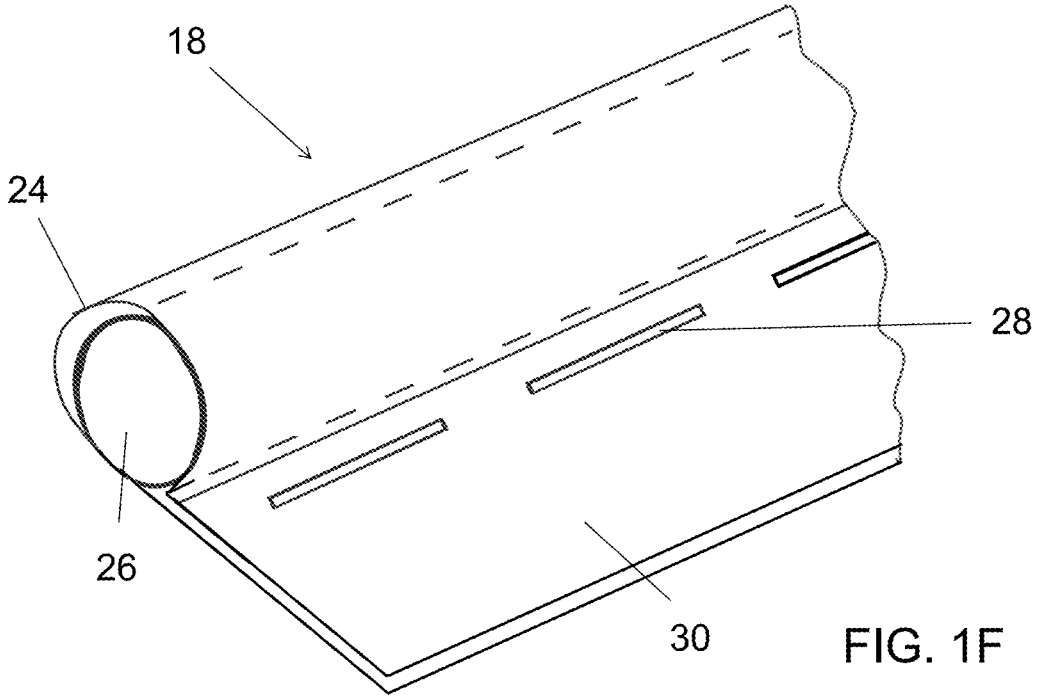
FIG. 1F is a perspective view of an example reflective element of the first example artwork, constructed of reflective fabric wrapped around a bendable member, having an unsealed end and including an extension along its length.
Figure 2A:
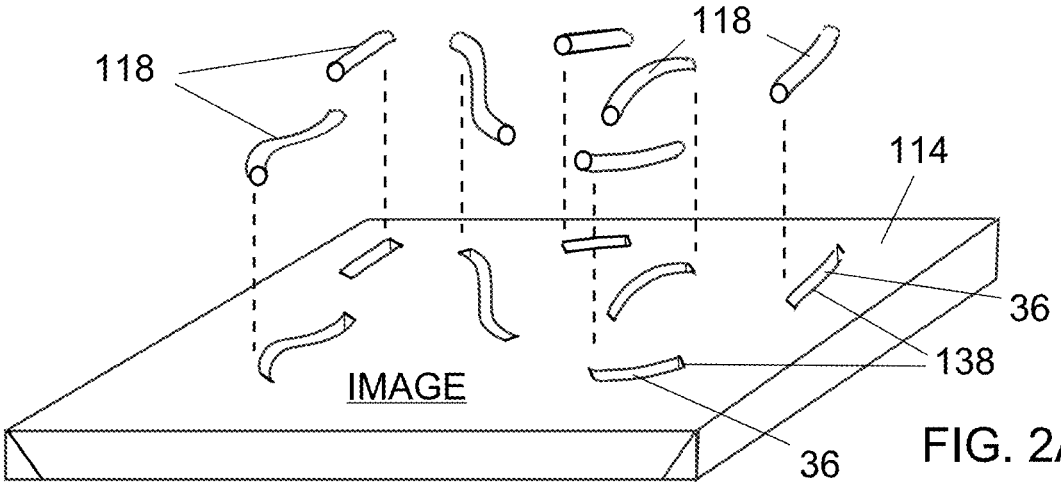
FIG. 2A is a perspective view of a second example artwork having elongated reflective elements to be connected to an image support medium that is extended over a frame (with the figures of the second example being shown without an image on the image support medium, for convenience of viewing the structures).
Figure 2B:
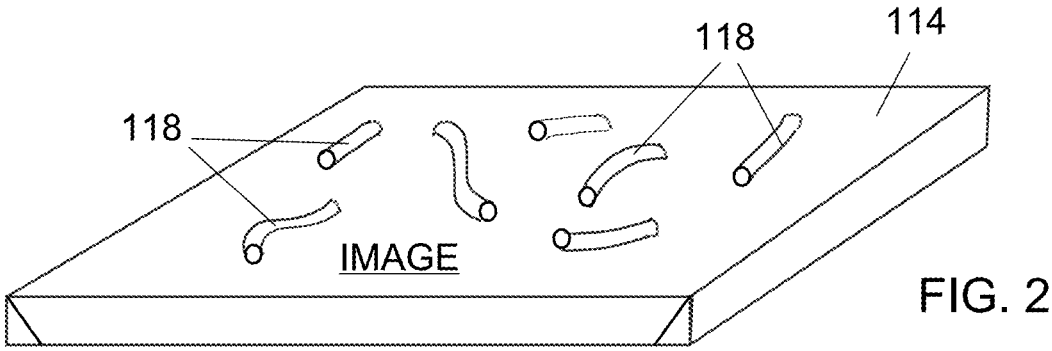
FIG. 2B is a perspective view of the second example artwork with the reflective elements connected to the image support medium and frame of FIG. 2A.

It will be appreciated that the plurality of reflective elements 18 may include reflective fabric 24 rolled or wrapped around a bendable member 26, such as a piece of wire, as shown in FIG. 1F. The fabric may be brought together, such as by staples 28, stitching, adhesive or other means of connection, and may form an extension 30 if desired, alone or by the addition of other fabric, for use in handling the reflective element and connecting it to the other structures. Alternatively, reflective piping or rope may be used to form reflective elements 118, such as is shown in FIGS. 2A-2B, or strips made with reflective material, such as paper, film, adhesive backed tape or the like, may be used to form reflective elements 218, such as is shown in FIGS.

Figure 4A:
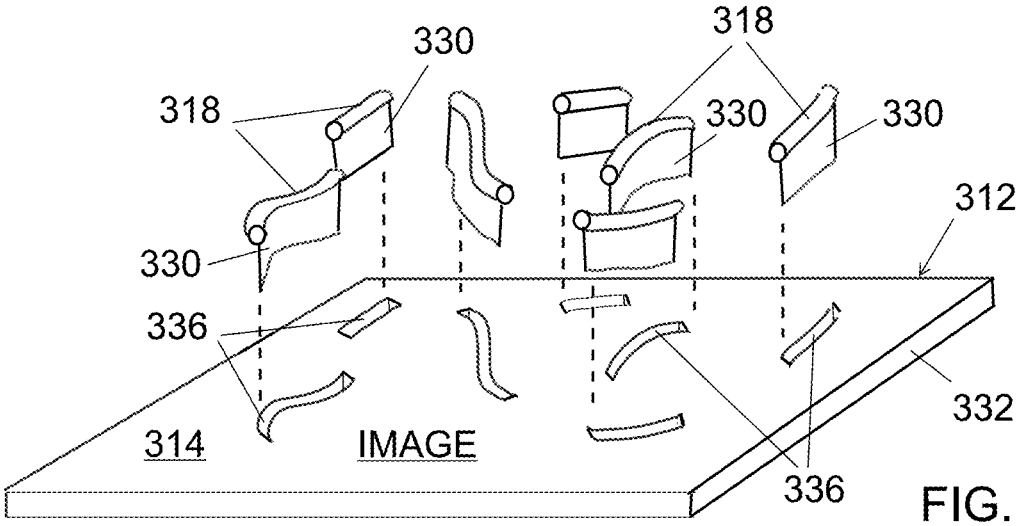
FIG. 4A is a perspective view of a fourth example artwork having elongated reflective elements to be connected to the surface of an image support medium that is the upper surface of a frame (with the figures of the fourth example being shown without an image on the image support medium, for convenience of viewing the structures).
Figure 4B:
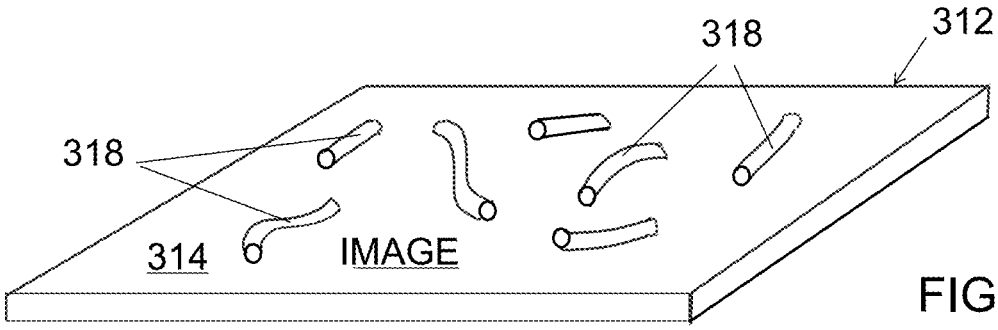
FIG. 4B is a perspective view of the fourth example artwork with the reflective elements connected to the image support medium that is the upper surface of the frame of FIG. 4A.

3A-3B. FIGS. 4A-4B show use of reflective elements 318 having extensions 330, similar to those shown with the first example, and being connected to an image support medium 314 that is provided by an upper surface of the frame 312.

Returning to the first example, FIG. 1C shows that the frame 12 optionally may include a plurality of connected frame members. Thus, the frame 12 may include a generally planar substrate 32 alone, or optionally may include members such as rails 34 that may be connected adjacent the edges of the generally planar substrate 32 of the frame 12, or members may be connected to the generally planar substrate 32 in other combinations and locates.

The generally planar substrate 32 may be constructed of wood, fiberboard, cardboard, foamboard, plastic, or other suitable material. If using rails 34, then rails 34 may be constructed of similar or different materials relative to the generally planar substrate 32. The rails 34 may be used to provide additional stiffness or depth to the artwork, and may present a finish level, when wrapped by the image support medium 14, which is suitable for hanging the artwork without a further decorative frame around its perimeter. The frame 12 also alternatively may include a plurality of connected frame members by extending the image support medium 14 directly over connected rails 34, without using a generally planar substrate 32. This method of construction may be appropriate when using reflective elements that are suitable for connection directly to the image support medium.

It will be appreciated that the generally planar substrate 32 may further include elongated apertures 36 therethrough, which may be useful to receive for connection certain forms of reflective elements 18, 118 or 318. The elongated apertures 36 may be formed by using an appropriate cutting tool, such as a rotary cutting tool, jig saw, jab saw, utility knife or other suitable tool.

The image support medium 14 may be adhered to the generally planar substrate 32, such as via adhesive, or as noted, may be the upper surface of the frame. To utilize the elongated apertures 36, an image support medium 14 extended over the frame 12 may include slits 38, which are generally aligned with the elongated apertures 36. Depending on the length of the blade of a knife or other cutting tool that may be used to form the slits 38, the slits 38 may be formed from one side, or the slits 38 may be started on one side to locate the ends of the underlying apertures 36 and finished after turning over the assembled image support medium 14 and generally planar substrate 32. The slits 38 also may simply be a cut in the image support medium 14 or may be formed as a slightly wider opening by removing material from the image support medium 14.

Figure 1G:
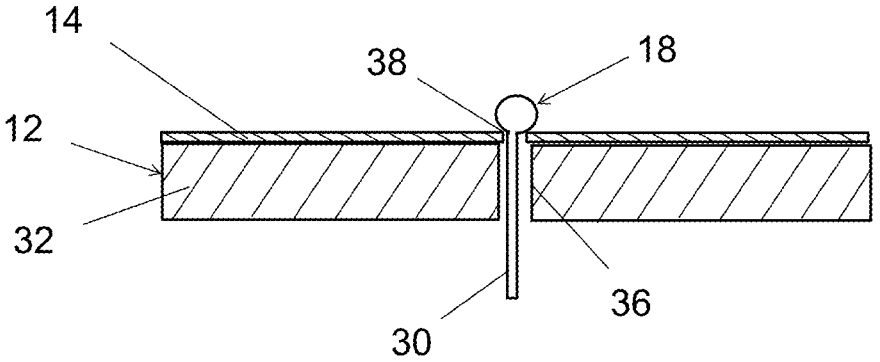
FIG. 1G is a side partial cross-sectional view toward a middle of the artwork and at an end of a slit in the image support medium and coinciding end of an elongated aperture in the frame of the first example, also showing a sealed end of an example reflective element of the type shown in FIG. 1F, and with the extension extending through the slit and aperture.
Figure 1H:
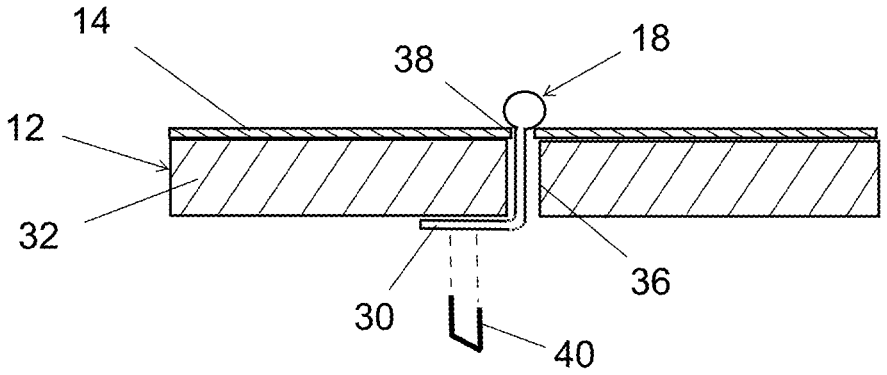
FIG. 1H is a side partial cross-sectional view similar to the example shown in FIG. 1G, but with the extension positioned to be connected to the rear side of the frame using a fastener.
Figure 1I:
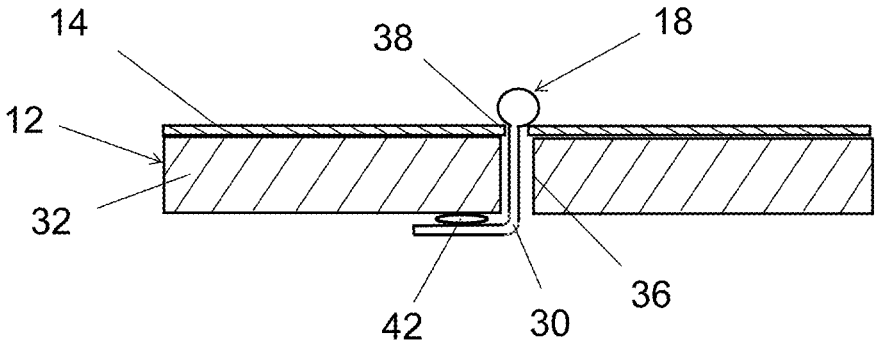
FIG. 1I is a side partial cross-sectional view similar to the example shown in FIG. 1H, but having the extension positioned to be connected to the rear side of the frame using adhesive.

In the first example, as shown in FIGS. 1G-1I, the plurality of reflective elements 18 may be connected to the image support medium 14 along the slits 38 and/or to the generally planar substrate 32 of the frame 12 along the elongated apertures 36. If the ends of the reflective elements 18 are constructed using reflective fabric, paper or film wrapped around a bendable member, such as the wire 26, the ends of the reflective elements 18 may be sealed to form a more finished appearance, such as by using caulk, which may be less noticeable if it is of similar color to the reflective material. The extension 30 of a reflective element 18 may be passed through a slit 38 and aperture 36 and pulled taught against the front of the image support medium 14 and then connected to the image support medium 14 and/or generally planar substrate 32 by various methods. Examples are shown in FIGS. 1H and 1I, wherein an extension 30 of a reflective element 18 is held in place along the rear of the generally planar substrate 32 by use of a suitable fastener 40, such as a staple or the like, or by use of other suitable means, such as adhesive 42 or the like. To conserve more costly reflective fabric, it will be appreciated that other non-reflective fabric or ribbon may be connected to a shorter extension to provide sufficient length to be suitably connected.

As seen in FIGS. 2A-2B, the reflective elements 118 may be formed of a reflective piping or rope. The corresponding use of wider slits 138 in the image support medium 114 and apertures 36 in the generally planar substrate may be useful when seeking to locate and connect the reflective elements 118, such as by introducing adhesive at the slits 138 and apertures 36 and then pressing the reflective elements 118 into place.

Figure 3A:
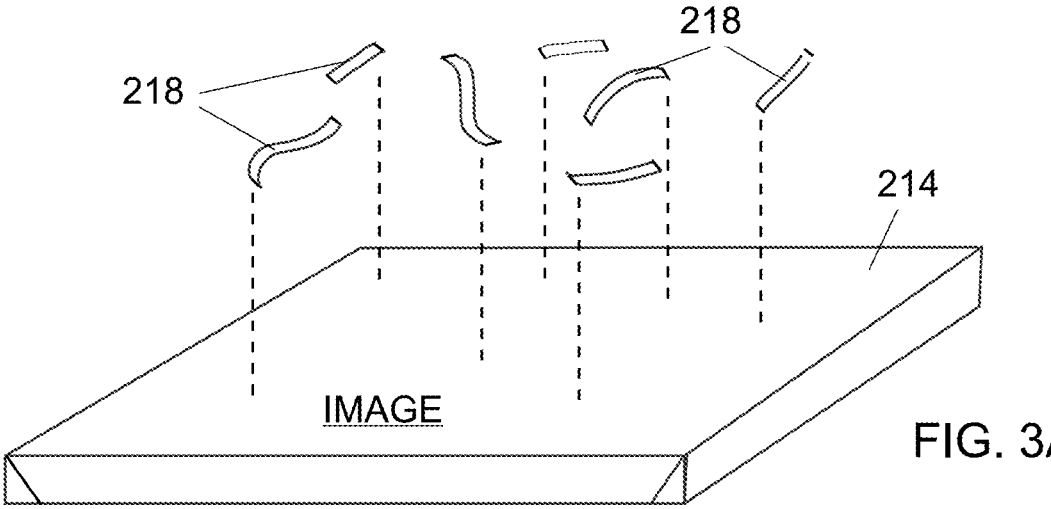
FIG. 3A is a perspective view of a third example artwork having elongated reflective elements to be connected to the surface of an image support medium that is extended over a frame (with the figures of the third example being shown without an image on the image support medium, for convenience of viewing the structures).
Figure 3B:
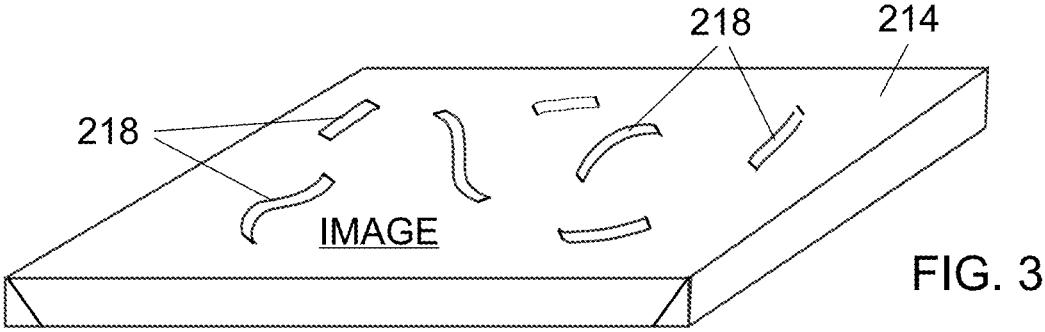
FIG. 3B is a perspective view of the third example artwork with the reflective elements connected to the image support medium that is extended over a frame of FIG. 3A.

FIGS. 3A-3B present a still further alternative construction, with the reflective elements 218 being formed of reflective fabric, paper or tape. Such reflective elements 218 may be connected directly to the image support medium 214, such as by use of adhesive, fasteners, sewing or other suitable means of connection.

FIGS. 4A-4B show another optional construction wherein the top surface of the frame 312 also is the image support medium 314. Thus, in this example, the image is applied directly to a generally planar substrate 332, which includes apertures 336. The reflective elements 318 are shown as being of the type seen in FIGS. 1F-1I with extensions 330, but alternatively may be formed of a reflective piping or rope, such may be seen in FIGS. 2A-2B. This is an optional construction that does not require a canvas or other additional layer, and the reflective elements 318 may be connected to the image support medium 314 and the associated generally planar substrate 332, via the methods previously described.

In light of the above description of the artwork 10 with respect to the first example shown in FIGS. 1A-1I, it will be appreciated that a method of preparing an artwork 10 having reflective elements includes the steps of obtaining a frame 12, preparing an image on an image support medium 14 that is on a surface of or is extended over the frame 12, connecting a plurality of reflective elements 18 to the image support medium 14, wherein the plurality of reflective elements 18 connected to the image support medium 14 has a generally non-reflective appearance when viewed at an angle that is not generally parallel with an incident ray of light, and has an illuminated appearance when viewed at an angle generally in line with an incident ray of light. It will be further appreciated that the method also may be used to prepare the alternative examples shown and described in FIGS. 2A-4B.

In light of the above description, the method of preparing an artwork 10 including the step of obtaining a frame may include obtaining a generally planar substrate 32, or may further include connecting together a plurality of frame members. This may include, for example, connecting a generally planar substrate 32 to rails 34, or alternatively may include connecting the rails 34 to be used without the generally planar substrate 32.

As noted above, the generally planar substrate 32 may include wood, fiberboard, cardboard, foamboard or plastic. The generally planar substrate 32 may further include elongated apertures 36 therethrough. The image support medium 14 may be adhered to the generally planar substrate 32 and further may includes slits 38 generally aligned with the elongated apertures 36 through the generally planar substrate 32, and wherein the plurality of reflective elements 18 is connected to the image support medium 14 directly along the slits 38 or indirectly via connection to the generally planar substrate 32 along the elongated apertures 36. As noted, the plurality of reflective elements 18 may be connected to the image support medium 14 or generally planar substrate 32 via adhesive or fasteners, whether in the form of sewing, mechanical or other suitable fasteners.

The image support medium 14 bearing an image 16 further includes a flexible sheet material constructed of a woven canvas, paper or plastic and the image 16 may be applied to the image support medium 14 via printing, drawing, painting or other suitable processes. The plurality of reflective elements 18, 318 may further include reflective fabric 24 wrapped around a bendable member 26, piping or rope 118 comprising reflective material, or strips 218 of reflective fabric, paper, tape or the like.

From the above disclosure, it will be apparent that an artwork having reflective elements constructed in accordance with this disclosure may include a number of structural aspects that provide numerous advantages, such as potential use of many different materials and types of art, concealed connections of the image support medium to the generally planar substrate, or of the reflective elements to the image support medium and/or generally planar substrate. The example aspects of such artwork described and shown herein may exhibit one or more of such potential advantages, depending upon the specific design chosen.

It will be appreciated that an artwork having reflective elements and a method of making the same may be incorporated into a visual artwork, which may for example be hung on a wall, may be made in accordance with the present disclosure and may be provided in various configurations. Any variety of suitable materials of construction, configurations, shapes and sizes for the components and methods of connecting the components may be utilized to meet the particular needs and requirements of an end user. It is to be understood that the invention is not to be limited to the examples disclosed herein, but rather, is intended to cover various modifications and equivalent arrangements included within the spirit and scope of the appended claims. Thus, the description and drawings should be considered illustrative and not restrictive of the invention, which is limited only by the appended claims and their legal equivalents.

The invention claimed is:

1. An artwork having reflective elements comprising:
a frame;
an image support medium bearing an image;
a plurality of elongated reflective elements;
the plurality of elongated reflective elements being connected to the image support medium, wherein the plurality of elongated reflective elements has a non-reflective appearance when viewed at an angle that is not parallel with an incident ray of light, and has an illuminated appearance when viewed at an angle in line with an incident ray of light; and
wherein the image on the image medium is a print, drawing or painting.

2. The artwork of claim 1, wherein a top surface of the frame further comprises the image support medium.

3. The artwork of claim 1, wherein the image support medium further comprises a flexible sheet material constructed of a woven canvas, paper or plastic and is extended over the frame.

4. The artwork of claim 1, wherein the plurality of reflective elements further comprise reflective fabric wrapped around a bendable member, piping or rope comprising reflective material, or strips of reflective fabric, paper or tape.

5. The artwork of claim 1, wherein the frame further comprises a plurality of connected frame members.

6. The artwork of claim 1, wherein the frame further comprises a generally planar substrate.

7. The artwork of claim 6, wherein the generally planar substrate further comprises wood, fiberboard, cardboard, foamboard or plastic.

8. The artwork of claim 7, wherein the generally planar substrate further comprises elongated apertures therethrough.

9. The artwork of claim 8, wherein the image support medium is adhered to the generally planar substrate and further comprises slits generally aligned with the elongated apertures through the generally planar substrate.

10. The artwork of claim 9, wherein the plurality of reflective elements is connected to the image support medium along the slits or to the generally planar substrate along the elongated apertures.

11. The artwork of claim 10, wherein the plurality of reflective elements is connected to the image support medium or generally planar substrate via staples or adhesive.

12. An artwork having reflective elements comprising:
a frame;
an image support medium bearing an image;
a plurality of elongated reflective elements;
the plurality of elongated reflective elements being connected to the image support medium, wherein the plurality of elongated reflective elements has a non-reflective appearance when viewed at an angle that is not parallel with an incident ray of light, and has an illuminated appearance when viewed at an angle in line with an incident ray of light; and
wherein the image support medium further comprises a flexible sheet material constructed of a woven canvas, paper or plastic and is extended over the frame.

13. The artwork of claim 12, wherein the plurality of reflective elements further comprise reflective fabric wrapped around a bendable member, piping or rope comprising reflective material, or strips of reflective fabric, paper or tape.

14. The artwork of claim 12, wherein the frame further comprises a plurality of connected frame members.

15. The artwork of claim 12, wherein the frame further comprises a generally planar substrate.

16. The artwork of claim 15, wherein the generally planar substrate further comprises wood, fiberboard, cardboard, foamboard or plastic.

17. The artwork of claim 16, wherein the generally planar substrate further comprises elongated apertures therethrough.

18. The artwork of claim 17, wherein the image support medium is adhered to the generally planar substrate and further comprises slits generally aligned with the elongated apertures through the generally planar substrate, and the plurality of reflective elements is connected to the image support medium along the slits or to the generally planar substrate along the elongated apertures.

19. An artwork having reflective elements comprising:
a frame;
an image support medium bearing an image;
a plurality of elongated reflective elements;
the plurality of elongated reflective elements being connected to the image support medium, wherein the plurality of elongated reflective elements has a non-reflective appearance when viewed at an angle that is not parallel with an incident ray of light, and has an illuminated appearance when viewed at an angle in line with an incident ray of light;

the frame further comprising a generally planar substrate that comprises wood, fiberboard, cardboard, foamboard or plastic, and the generally planar substrate further comprising elongated apertures therethrough.

20. The artwork of claim 19, wherein the image support medium is adhered to the generally planar substrate and further comprises slits generally aligned with the elongated apertures through the generally planar substrate.

21. The artwork of claim 20, wherein the plurality of reflective elements is connected to the image support medium along the slits or to the generally planar substrate along the elongated apertures.

22. The artwork of claim 21, wherein the plurality of reflective elements is connected to the image support medium or generally planar substrate via staples or adhesive.

* * * * *